US008726690B2

(12) United States Patent
Cur et al.

(10) Patent No.: US 8,726,690 B2
(45) Date of Patent: May 20, 2014

(54) INSULATION PANELS APPLIED TO OR AS A FEATURE MODULE

(75) Inventors: Nihat O. Cur, Saint Joseph, MI (US); Steven J. Kuehl, Stevensville, MI (US); Luiz Antonio D. Lopes, Saint Joseph, MI (US); John J. Vonderhaar, Saint Joseph, MI (US); John R. Wisnoski, Haubstadt, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 96 days.

(21) Appl. No.: 13/219,752

(22) Filed: Aug. 29, 2011

(65) Prior Publication Data

US 2011/0315693 A1 Dec. 29, 2011

Related U.S. Application Data

(63) Continuation of application No. 12/466,398, filed on May 15, 2009, now abandoned.

(51) Int. Cl.
*F25D 11/02* (2006.01)
*F25D 23/06* (2006.01)

(52) U.S. Cl.
CPC ..... *F25D 23/06* (2013.01)
USPC ..... 62/447

(58) Field of Classification Search
CPC ..... F25D 23/06; F25D 23/08
USPC ..... 62/56, 440, 447; 312/400
See application file for complete search history.

(56) References Cited

U.S. PATENT DOCUMENTS

| | | | | | |
|---|---|---|---|---|---|
| 1,793,857 | A * | 2/1931 | Kettering et al. | 62/201 |
| 2,586,853 | A * | 2/1952 | Morton | 62/198 |
| 2,779,066 | A * | 1/1957 | Gaugler et al. | 312/406 |
| 3,913,996 | A * | 10/1975 | Benford | 312/406 |
| 4,043,624 | A * | 8/1977 | Lindenschmidt | 312/406 |
| 5,007,226 | A * | 4/1991 | Nelson | 52/784.15 |
| 5,368,381 | A * | 11/1994 | Mandel | 312/406.2 |
| 5,512,345 | A * | 4/1996 | Tsutsumi et al. | 428/69 |
| 5,555,189 | A * | 9/1996 | Yamazato et al. | 700/286 |
| 5,632,543 | A * | 5/1997 | McGrath et al. | 312/406 |
| 5,890,785 | A * | 4/1999 | Vismara | 312/406 |
| 6,128,914 | A * | 10/2000 | Tamaoki et al. | 62/440 |
| 6,322,869 | B1 * | 11/2001 | Dietrich | 428/69 |
| 6,408,841 | B1 * | 6/2002 | Hirath et al. | 126/19 R |
| 6,658,883 | B1 * | 12/2003 | Rainbolt | 62/263 |
| 7,316,125 | B2 * | 1/2008 | Uekado et al. | 62/440 |
| 2003/0080660 | A1 * | 5/2003 | Kawasumi et al. | 312/400 |

FOREIGN PATENT DOCUMENTS

| | | | | |
|---|---|---|---|---|
| DE | EP0660056 A1 * | 6/1995 | | F25D 23/02 |
| EP | 0660056 A1 * | 6/1995 | | F25D 23/02 |

* cited by examiner

*Primary Examiner* — Mohammad M Ali
*Assistant Examiner* — Emmanuel Duke

(57) ABSTRACT

A refrigerator includes a rear wall, a first side wall, a second side wall, a top wall, and a bottom wall that are permanently attached to define a cabinet. The cabinet includes an interior liner and an exterior wrapper. A door is pivotally connected with the cabinet and includes an interior liner and an exterior wrapper. A pocket is disposed in at least one of the rear wall, first side wall, second side wall, top wall, bottom wall, and door between the interior liner and the exterior wrapper. The pocket includes an access opening disposed at an edge of one of the rear wall, first side wall, second side wall, top wall, and bottom wall. A removable insulation panel is disposed in the pocket.

7 Claims, 11 Drawing Sheets

INSULATION PANELS APPLIED TO OR AS A FEATURE MODULE

CROSS-REFERENCE TO RELATED APPLICATIONS

This application is a continuation of and claims priority to U.S. patent application Ser. No. 12/466,398, filed on May 15, 2009, entitled "INSULATION PANELS APPLIED TO OR AS A FEATURE MODULE," the entire disclosure of which is hereby incorporated herein by reference.

BACKGROUND OF THE PRESENT INVENTION

The present invention generally relates to an insulation panel and, more specifically, to an insulation panel applied to or as a feature module in a refrigerator.

SUMMARY OF THE INVENTION

In one aspect of the present invention, a refrigerator includes a rear wall, a first side wall, a second side wall, a top wall, and a bottom wall that are permanently attached to define a cabinet. The cabinet includes an interior liner and an exterior wrapper. A door is pivotally connected with the cabinet and includes an interior liner and an exterior wrapper. A pocket is disposed in at least one of the rear wall, first side wall, second side wall, top wall, bottom wall, and door between the interior liner and the exterior wrapper. The pocket includes an access opening disposed at an edge of one of the rear wall, first side wall, second side wall, top wall, and bottom wall. A removable insulation panel is disposed in the pocket.

In another aspect of the present invention, a refrigerator includes an interior liner having a rear wall, a first side wall, a second side wall, a top wall, and a bottom wall, all integrally formed together. An exterior wrapper includes a rear wall, a first side wall, a second side wall, a top wall, and a bottom wall all permanently attached together. At least one cavity extends through one of the rear wall, first side wall, second side wall, top wall, and bottom wall of the exterior wrapper. A removable insulative member is disposed in the at least one cavity.

In yet another aspect of the present invention, a method of making a refrigerator includes forming an exterior wrapper by permanently attaching a rear wall, a first side wall, a second side wall, a top wall, and a bottom wall together. An interior liner is integrally formed for installation into the exterior wrapper. A pocket is formed in one of the rear wall, first side wall, second side wall, top wall, and bottom wall between the interior liner and the exterior wrapper. An access opening to the pocket is formed at an edge of one of the rear wall, first side wall, second side wall, top wall, and bottom wall. A removable insulation panel is inserted in the pocket.

In yet another aspect of the present invention, a method of using a refrigerator includes forming an exterior wrapper by permanently attaching a rear wall, a first side wall, a second side wall, a top wall, and a bottom wall together. An interior liner is integrally formed. The interior liner is permanently installed inside the exterior wrapper. A utility line is connected between the refrigerator and an external modular component. A cavity is formed in at least one of the rear wall, first side wall, second side wall, top wall, and bottom wall adjacent the interior liner. A removable insulative member is inserted in the cavity to reduce heat gain to an interior portion of the refrigerator.

These and other features, advantages, and objects of the present invention will be further understood and appreciated by those skilled in the art upon studying the following specification, claims, and appended drawings.

DETAILED DESCRIPTION OF EMBODIMENTS

Figure 1:
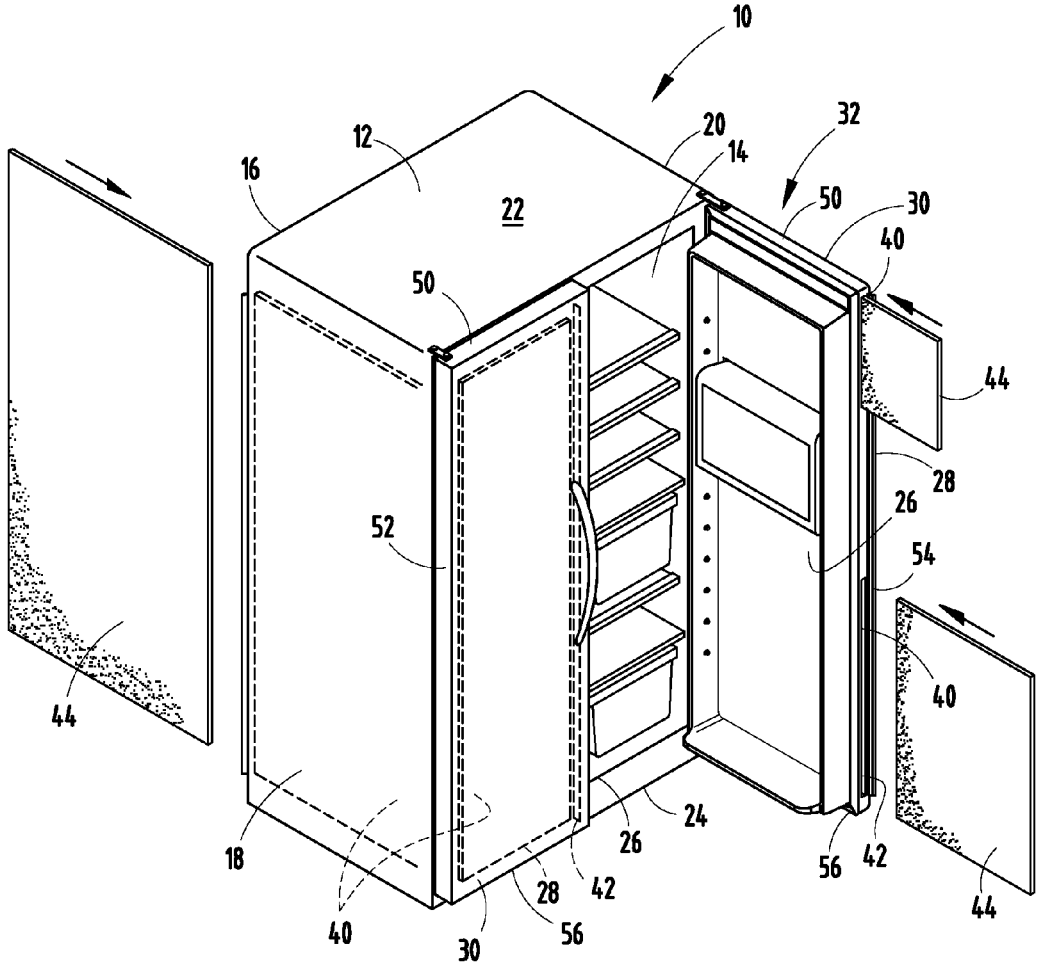
FIG. 1 is a top front perspective view of a refrigerator incorporating one embodiment of a insulation panel of the present invention.

For purposes of description herein the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
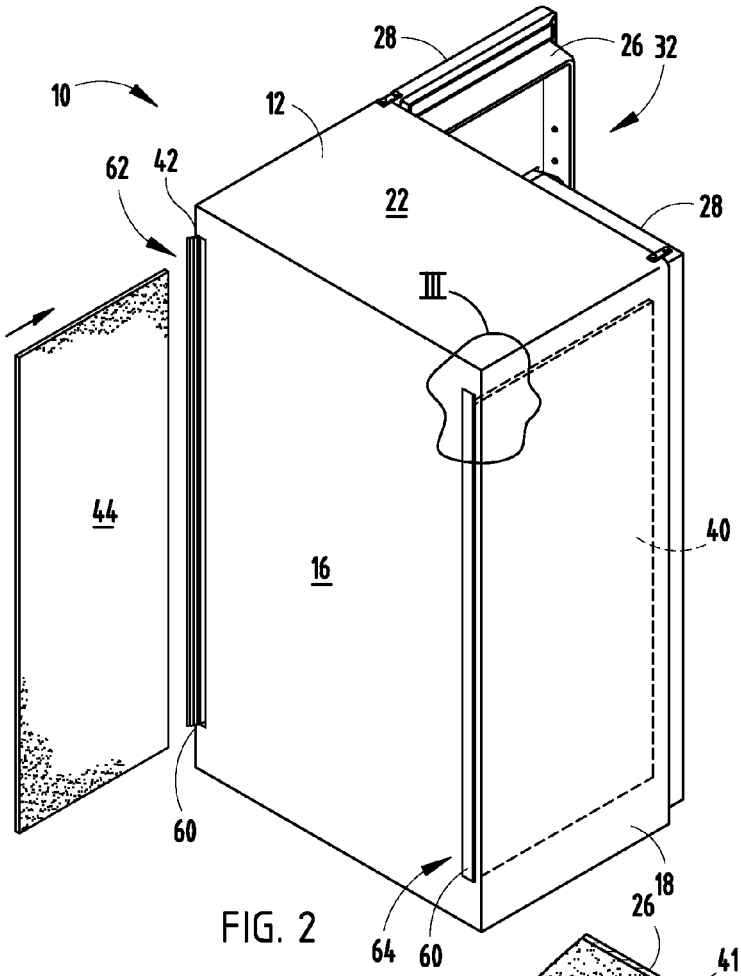
FIG. 2 is a top rear perspective view of the refrigerator of FIG. 1.
Figure 3:
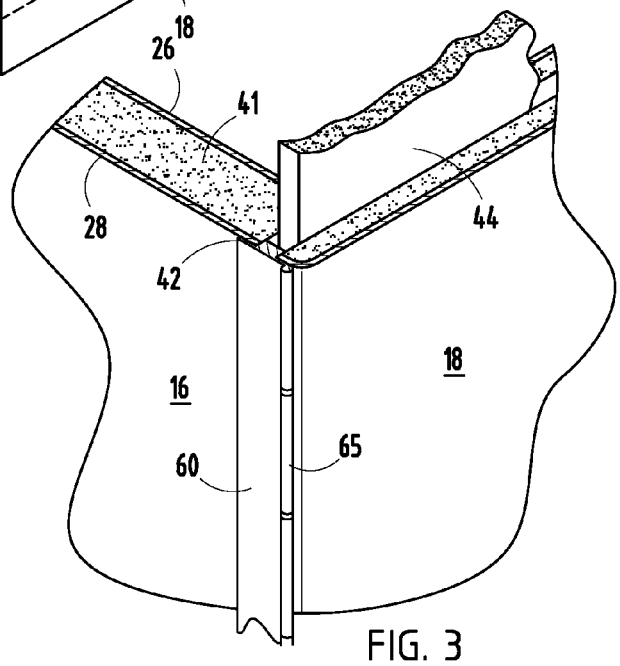
FIG. 3 is an enlarged partial rear perspective view of area III of FIG. 2.
Figure 4:
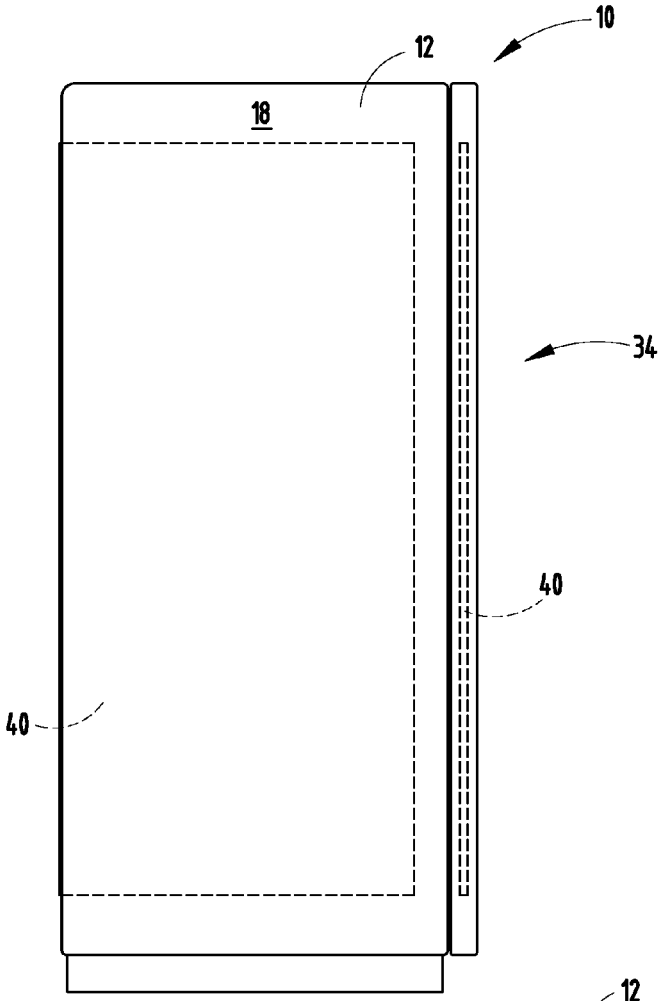
FIG. 4 is a side elevational view of the refrigerator of FIG. 1 with the doors closed.
Figure 5:
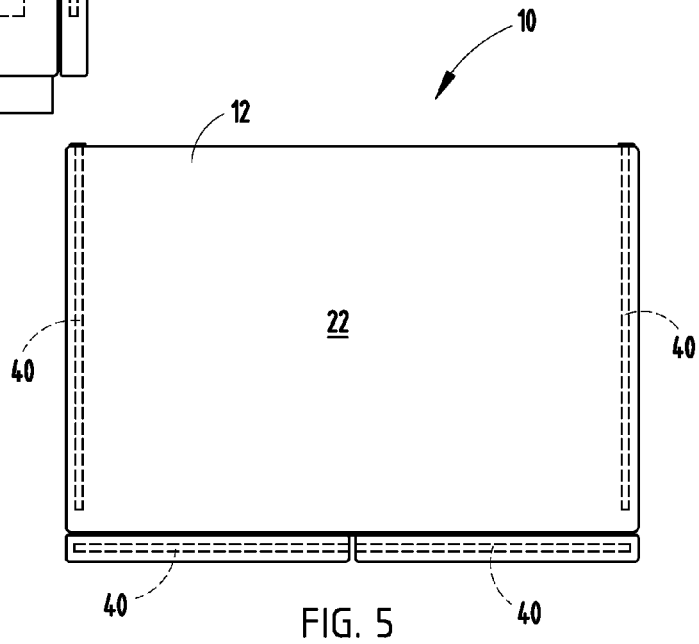
FIG. 5 is a top elevational view of the refrigerator of FIG. 1 with the doors closed.

The reference numeral 10 shown in FIGS. 1-3 generally designates a refrigerator having a cabinet 12 defining an open storage space 14 and having a rear wall 16, a first side wall 18, a second side wall 20, a top wall 22, and a bottom wall 24. Each of the rear wall 16, first side wall 18, second side wall 20, top wall 22, and bottom wall 24 include an interior liner 26 and an exterior wrapper 28. A door 30 is disposed on the cabinet 12 and is operable between an open position 32 and a closed position 34 (FIG. 4). The door 30 also includes an interior liner 26 and an exterior wrapper 28. At least one pocket 40 is disposed in at least one of the rear wall 16, first side wall 18, second side wall 20, top wall 22, bottom wall 24, and door 30 between the interior liner 26 and the exterior wrapper 28. The at least one pocket 40 includes an access opening 42. A removable insulation panel 44 is disposed in the pocket 40.

Referring now to FIGS. 1-5, the pockets 40 are disposed between the interior liner 26 and the exterior wrapper 28 of the refrigerator 10 where a standard insulation 41 is typically positioned. The pockets 40 are designed to receive a single removable insulation panel 44 or a plurality of insulation panels 44. The removable insulation panel may be constructed as a vacuum insulation panel or as an expanded polystyrene panel, polyurethane panel, or an aerogel panel. It is contemplated that the access opening 42 could be disposed on any of the four edges of any wall 16, 18, 20, 22, 24. For example, with respect to the refrigerator door 30, it is contemplated that the access opening 42 could be disposed on a top edge 50, a first side edge 52, a second side edge 54, or a bottom edge 56 of the refrigerator door 30. The access opening 42 is designed to closely receive the insulation panel 44 so that little space is left unfilled. The pocket 40 includes a pocket door 60 adjacent to the access opening 42 that is operable between an open position 62 and a closed position 64. The pocket door 60 seals the access opening 42 when in the closed position 64. The pocket door 60 also prevents dust and condensation from getting inside the pocket 40 of the refrigerator 10. The pocket door 60 is connected by a hinge 65. It is contemplated that the pocket door 60 may be connected to the refrigerator 10 in a variety of other manners, including a friction fit, a magnetic attraction to the exterior wrapper 28 of the refrigerator 10, hook and loop fasteners, an adhesive connection, etc.

The insulation panels 44 provide versatility in the efficiency of the refrigerator 10. This versatility allows for accommodating various food goods, such as frozen goods, which require low temperature and high efficiency from the refrigerator 10, refrigerated goods, which require less efficiency, but still maintain a moderately low temperature, as well as red wines, which are generally stored at or slightly below room temperature, and white wines that are stored at a typical refrigerator temperature. Use of various insulation panels 44 allow for accommodating different food groups.

Figure 6:
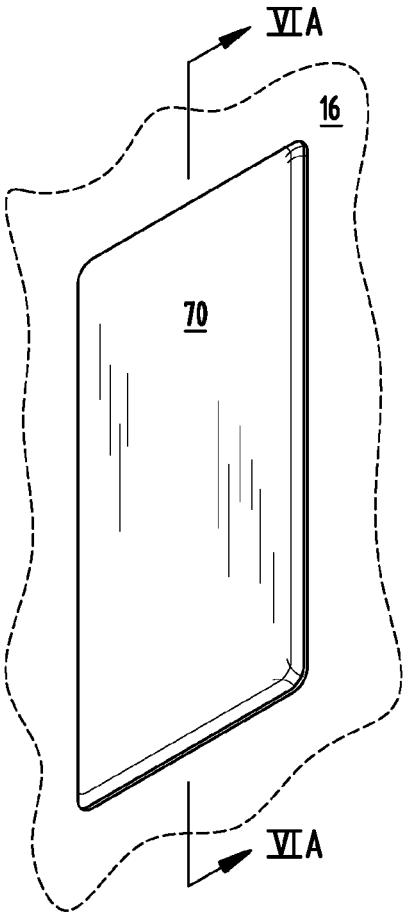
FIG. 6 is a top partial perspective view of a cavity located on an interior wall of a refrigerator.
Figure 6A:
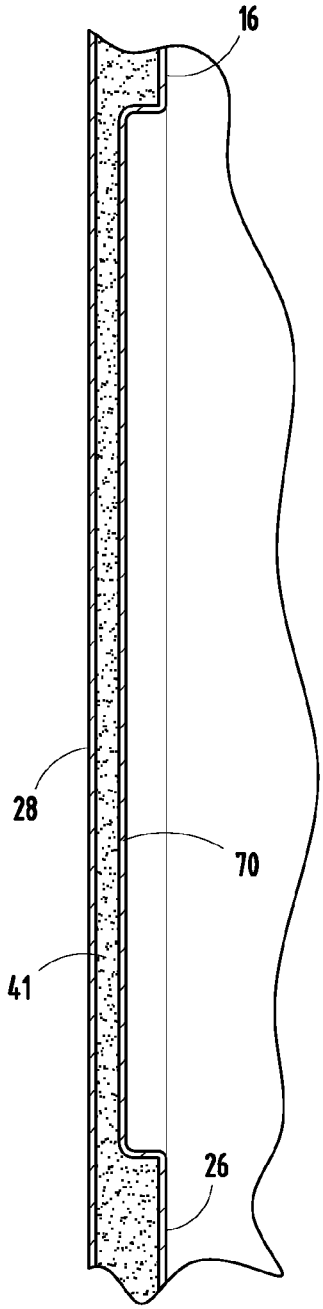
FIG. 6A is a side cross-sectional elevational view taken at VIA-VIA.
Figure 7:
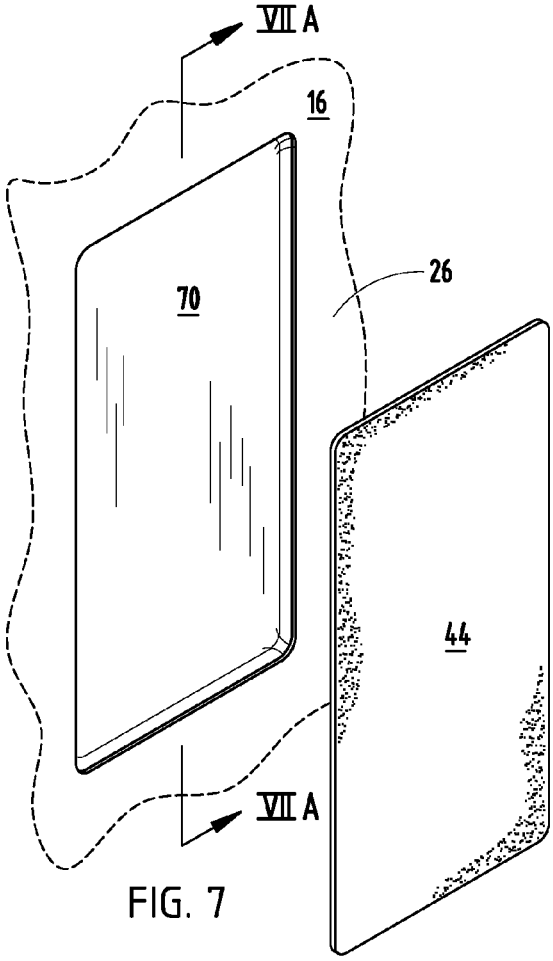
FIG. 7 is a top partial perspective view of the cavity of FIG. 6 during installation of an insulation panel.
Figure 7A:
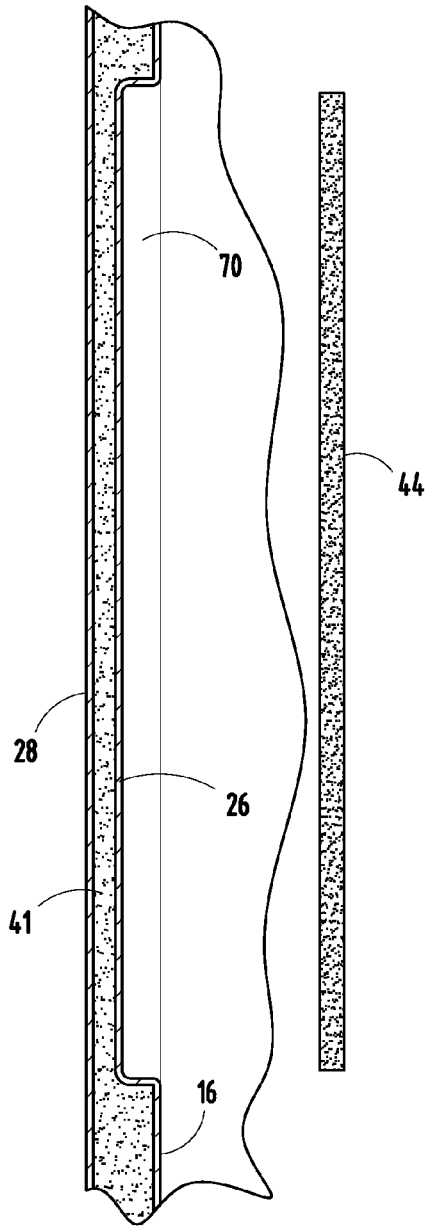
FIG. 7A is a cross-sectional view taken at VIIA-VIIA of FIG. 7.

FIGS. 6-9 illustrate another embodiment of the insulation panel 44 utilized in the refrigerator 10. The refrigerator 10 includes a cavity 70 formed in one of the rear wall 16, first side wall 18, second side wall 20, top wall 22, bottom wall 24, and door 30, that is designed to receive the insulation panel 44. For example only, the position of the cavity 70 in the rear wall 16 will be discussed below (FIGS. 6 and 6A). During installation, the insulation panel 44 is placed against the interior liner 26 in the cavity 70. Alternatively, a portion of the interior liner 26 may be cut away or removed, in which case the insulation panel 44 is placed adjacent to an interior portion of the rear wall 16, first side wall 18, second side wall 20, top wall 22, bottom wall 24, or door 30. A protective cover panel 72 can be applied over the insulation panel 44 to protect the insulation panel 44 and prevent dust and debris from getting into the cavity 70. During use, the cavity 70 is made available by removing the protective cover panel 72. After the protective cover panel 72 has been removed, the insulation panel 44 is inserted into the cavity 70, such that the planar extent of the insulation panel 44 is substantially co-planar with the interior liner 26 of the refrigerator 10 (FIG. 7A). It is contemplated that insulation panels 44 of varying thicknesses may be used, some of which may be thicker or thinner than the depth of the cavity 70. The cover panel 72 may include a handle or finger notch 71 to assist in opening the cover panel 72.

Figure 8:
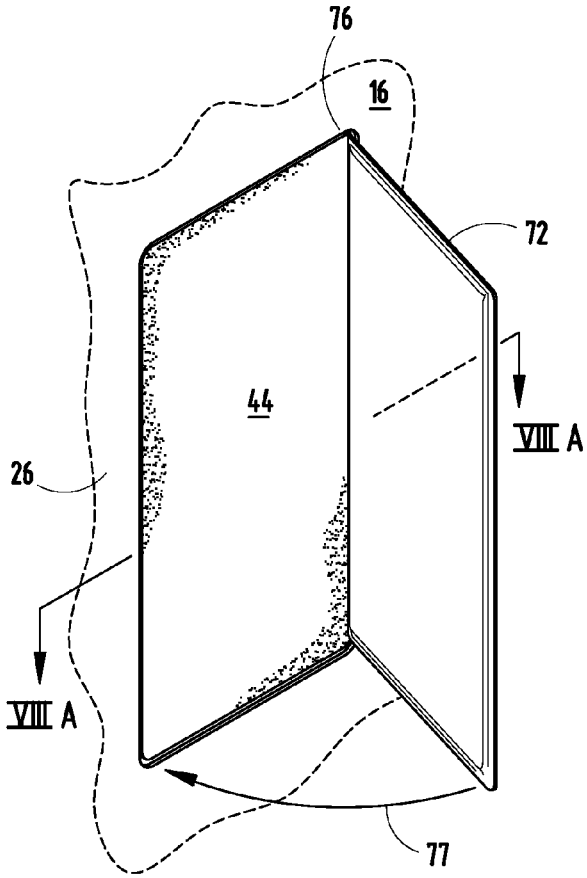
FIG. 8 is a top partial perspective view of the cavity after the insulation panel has been installed and during installation of a cover panel over the insulation panel.
Figure 8A:
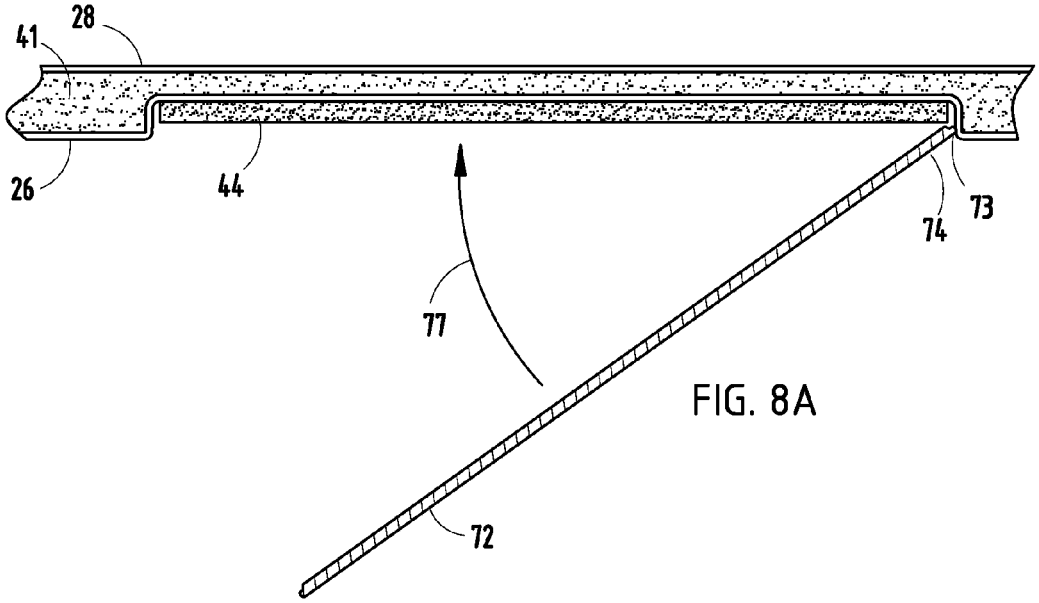
FIG. 8A is a top cross-sectional elevational view taken at VIIIA-VIIIA of FIG. 8.
Figure 9:
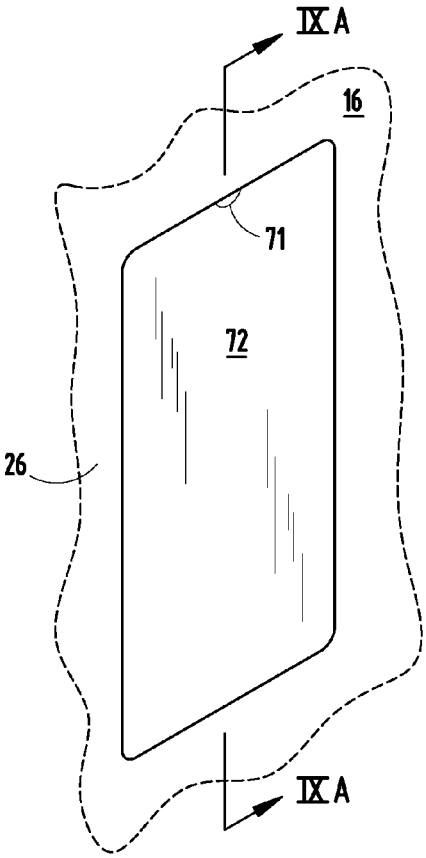
FIG. 9 is a top partial perspective view of the cavity of FIG. 6 after an insulation panel and a cover panel have been installed in the cavity.
Figure 9A:
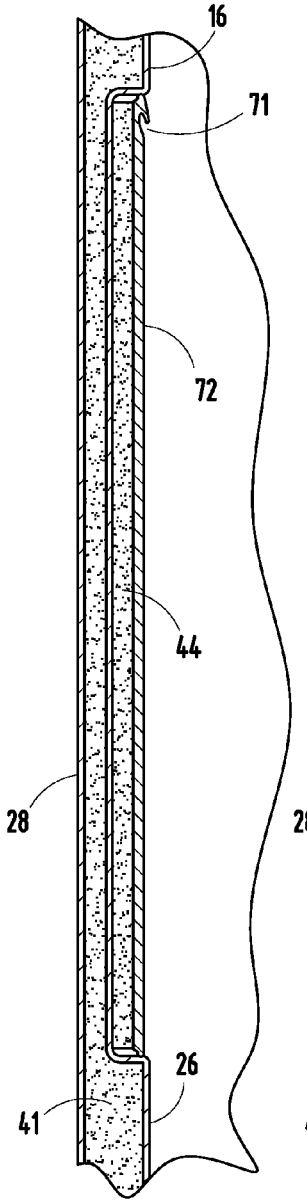
FIG. 9A is a side cross-sectional elevational view taken at IXA-IXA of FIG. 9.

Referring now to FIGS. 8 and 8A, after the insulation panel 44 has been installed in the cavity 70, the protective cover panel 72 is installed over the cavity 70. The illustrated embodiment shows an engagement flange 73 on a rear portion 74 of the cover panel 72 that engages a rear portion 76 of the cavity 70. The cover panel 72 is then swung in the direction of arrow 77 until the cover panel 72 completely conceals the insulation panel 44. The cover panel 72 may be held in place by fasteners of a mechanical or magnetic nature. Alternatively, the cover panel 72 may be secured by a friction fit or another possible closure device. After the cover panel 72 has completely concealed the insulation panel 44, as shown in FIGS. 9 and 9A, the efficiency of the refrigerator 10 is increased, such that less energy is needed to keep food goods cold that are stored inside the refrigerator 10. As shown in FIG. 10, the cover panel 72 may also be installed over the cavity 70 without first inserting the insulation panel 44. It is also contemplated that module components, such as air canisters for a modified atmosphere system, may be stored in the cavity 70 or connected to the refrigerator 10 through the cavity 70.

Figure 10A:
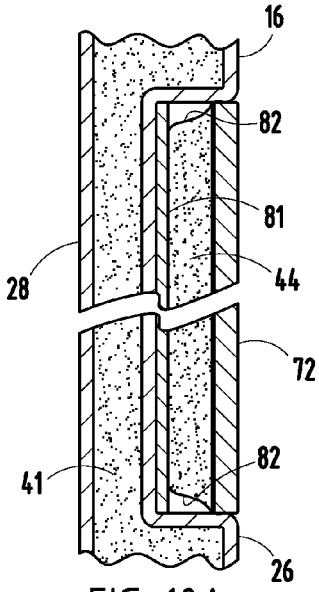
FIG. 10A is a side cross-sectional view of a cavity on the interior wall of a refrigerator with an insulation panel that is integral with a cover panel installed in the cavity.
Figure 10:
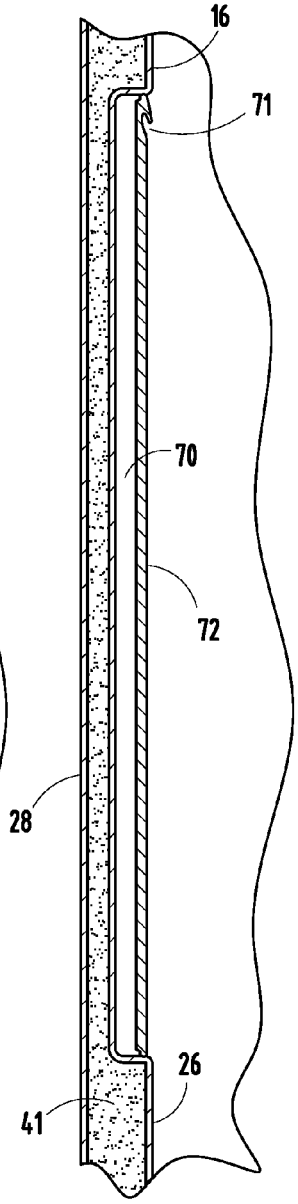
FIG. 10 is a side cross-sectional view of a cavity on the interior wall of a refrigerator with the cover panel installed, but without an insulation panel.
Figure 11:
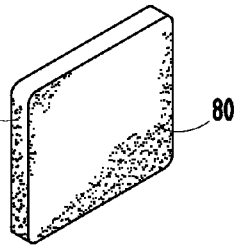
FIG. 11 is a top perspective view of a removable module insulation plug.

Referring to FIG. 10A, in another embodiment, the insulation panel 44 is fixedly attached to the cover panel 72. The insulation panel 44 and cover panel 72 combination has tapered edges 82 that allow for an aesthetically pleasing transition from the side wall to the cover panel 72. The insulation panel 44 and cover panel 72 combination is held in the cavity 70 by adhesive strips 81. It is contemplated that the adhesive strips 81 could be replaced with a chemical fastener, such as caulk adhesive, disposed around the periphery interface between the cover panel 72 and the cavity 70. It is also contemplated that expanded polystyrene or polyurethane could be shaped to form the insulation panel 44 and used in the cavity 70.

Figure 12:
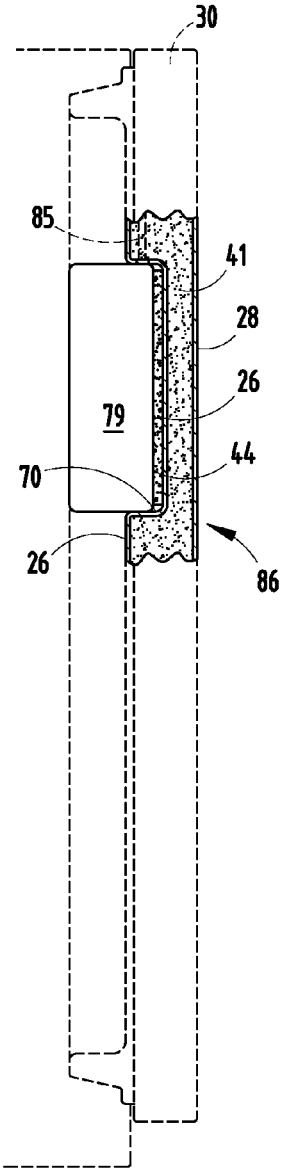
FIG. 12 is a side cross-sectional elevational view of a refrigerator door having a removable module and an insulation panel received in a cavity in the refrigerator door.
Figure 13:
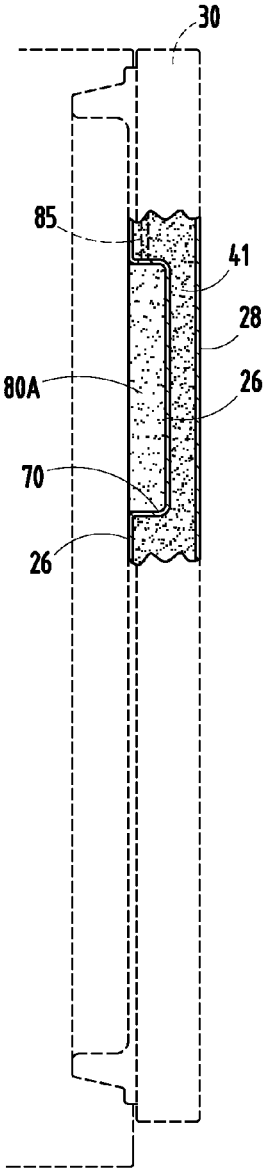
FIG. 13 is a side cross-sectional elevational view of a portion of a refrigerator door with a cavity and an insulation plug.
Figure 13A:
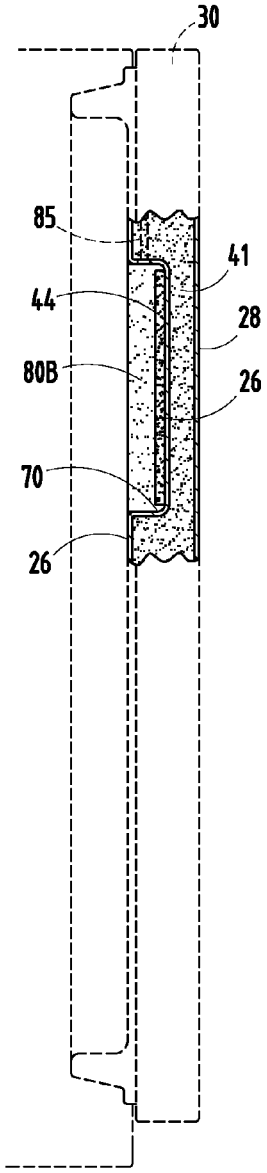
FIG. 13A is a side cross-sectional elevational view of a portion of a refrigerator door with an insulation plug having an insulation panel.
Figure 13B:
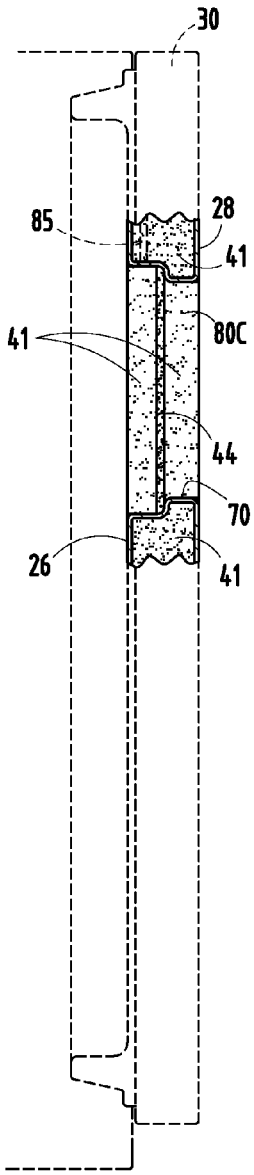
FIG. 13B is a side cross-sectional elevational view of another embodiment of a portion of a refrigerator door with an insulation plug having an insulation panel.

FIGS. 11-13C illustrate yet another embodiment of the present invention. FIG. 12 includes use of an insulation panel 44 between a removable module 79 and the interior liner 26 of the refrigerator 10. A removable module insulation plug 80 is incorporated into the cavity 70 in one of the rear wall 16, first side wall 18, second side wall 20, top wall 22, bottom wall 24, or door 30. For example, the illustrated embodiment has the plug 80 in the door 30. The plug 80 may have a variety of constructions. Specifically, the plug 80 may be a standard insulation plug 80A (FIG. 13) that utilizes insulation 41 typically used in the walls and doors of the refrigerator 10. Alternatively, as shown in FIG. 13A, the plug 80 may be a combination plug 80B that has standard insulation 41 and insulation panel 44. Another configuration for plug 80 is combination plug 80C (FIG. 13B). Combination plug 80C has the insulation panel 44 sandwiched between two layers of standard insulation 41. The combination plug 80C is likely to be used when the cavity 70 is designed to receive the removable module 79 that extends completely through one of the rear wall 16, first side wall 18, second side wall 20, top wall 22, bottom wall 24, or door 30. The plug 80 may include the exterior wrapper having a planar extent that is co-planar with the planar extent of the exterior wrapper 28 of the refrigerator 10. Further, an inside portion of the plug 80 may be co-planar with an inside portion of the door 30, or may extend slightly outwardly or inwardly relative to the planar extent of the door 30 in the cabinet 12.

Referring again to FIG. 12, the illustrated embodiment shows the insulation panel 44 sandwiched between the removable module 79 and the door 30. The insulation panel 44 increases the efficiency of the door 30 at the cavity 70, such that additional standard insulation is unnecessary. The insulation panel 44 is thin enough that the cavity 70 is still able to accommodate the removable module 79 positioned in the door 30. The removable module 79 could be any of a number of different varieties of removable modules, including a vacuum sealing module or modified atmosphere module, for example. The removable module 79 connects with a utility line 85 in communication with the cavity 70. The utility line 85 may include a cold air line, refrigerant line, conditioned water line, electrical power line, electrical signal line, pneumatic line for power or signal communication, or any combination thereof, and is designed for connection with the removable module 79 when installed in cavity 70. The insulation panel 44 minimizes losses in insulative capability associated with having the cavity 70. Specifically, the cavity 70 creates a thinner wall or door area 86 that could otherwise lead to thermal loss. Accordingly, the insulation panel 44 lessens this loss and is thin enough to allow insertion of the removable module 79 into the door 30, for example. When the removable module 79 is not being used, the removable insulation plug 80 is installed adjacent to the insulation panel 44 inside the cavity 70 to prevent thermal loss.

Figure 14:
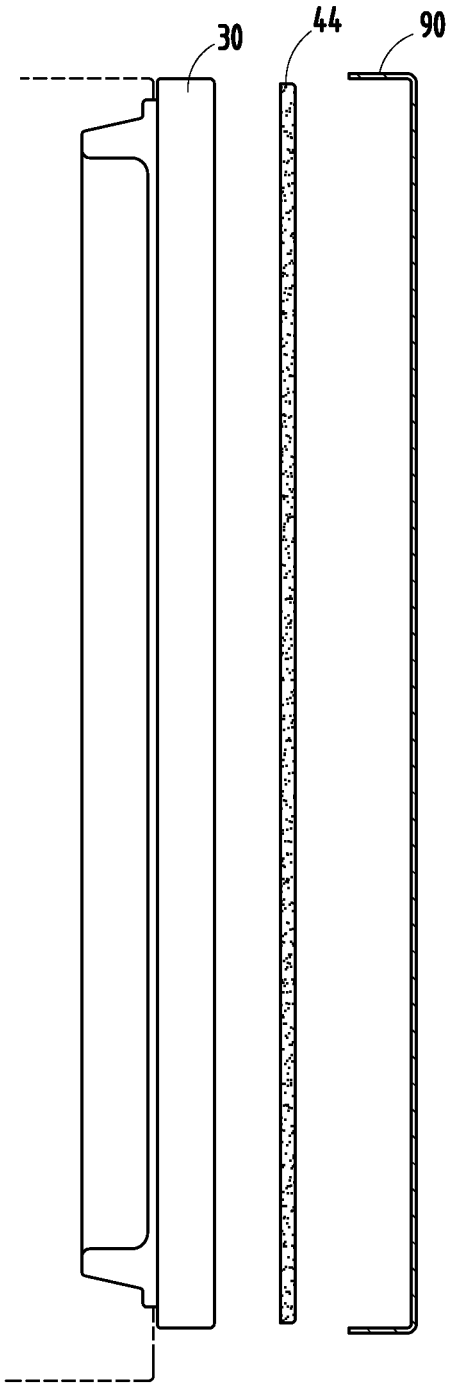
FIG. 14 is an exploded side elevational view of a refrigerator door, insulation panel, and exterior skin.
Figure 14A:
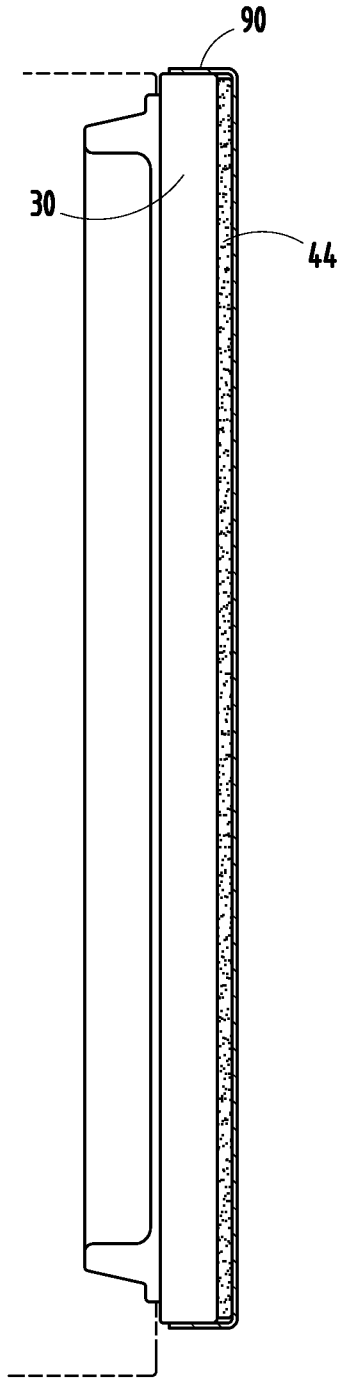
FIG. 14A is a side elevational view of a refrigerator door with an insulation panel and exterior skin covering the front of the refrigerator door.
Figure 15:
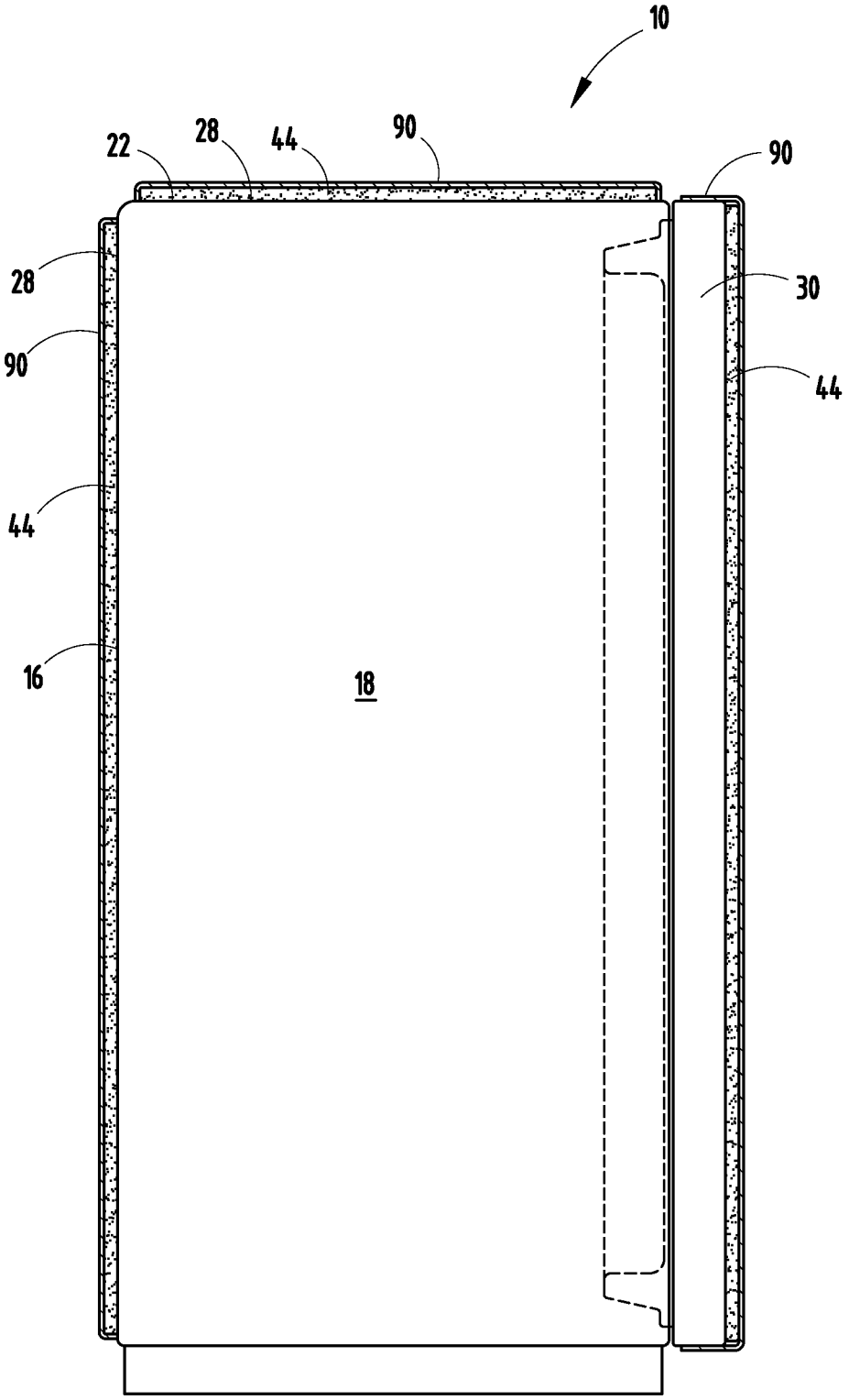
FIG. 15 is a side elevational view of a refrigerator having an insulation panel and an exterior skin disposed on a rear side, top side, and door of the refrigerator.

Referring now to FIGS. 14, 14A, and 15, in yet another embodiment of the present invention, the insulation panel 44 is applied to the exterior wrapper 28 of the refrigerator door 30. A skin 90 is applied over the insulation panel 44 to cover the insulation panel 44 and keep the insulation panel 44 tight against the exterior wrapper 28 of the refrigerator wall 16, 18, 20, 22, 24 or door 30, as shown in FIG. 14A. The skin 90 is applied whenever insulation panels 44 are added to the refrigerator 10. The skin 90 may be connected to the door 30 mechanically, magnetically, or chemically (i.e., adhesive). Also, the skin 90 may be applied to multiple walls 16, 18, 20, 22, 24 or door 30 simultaneously (FIG. 15).

Figure 16:
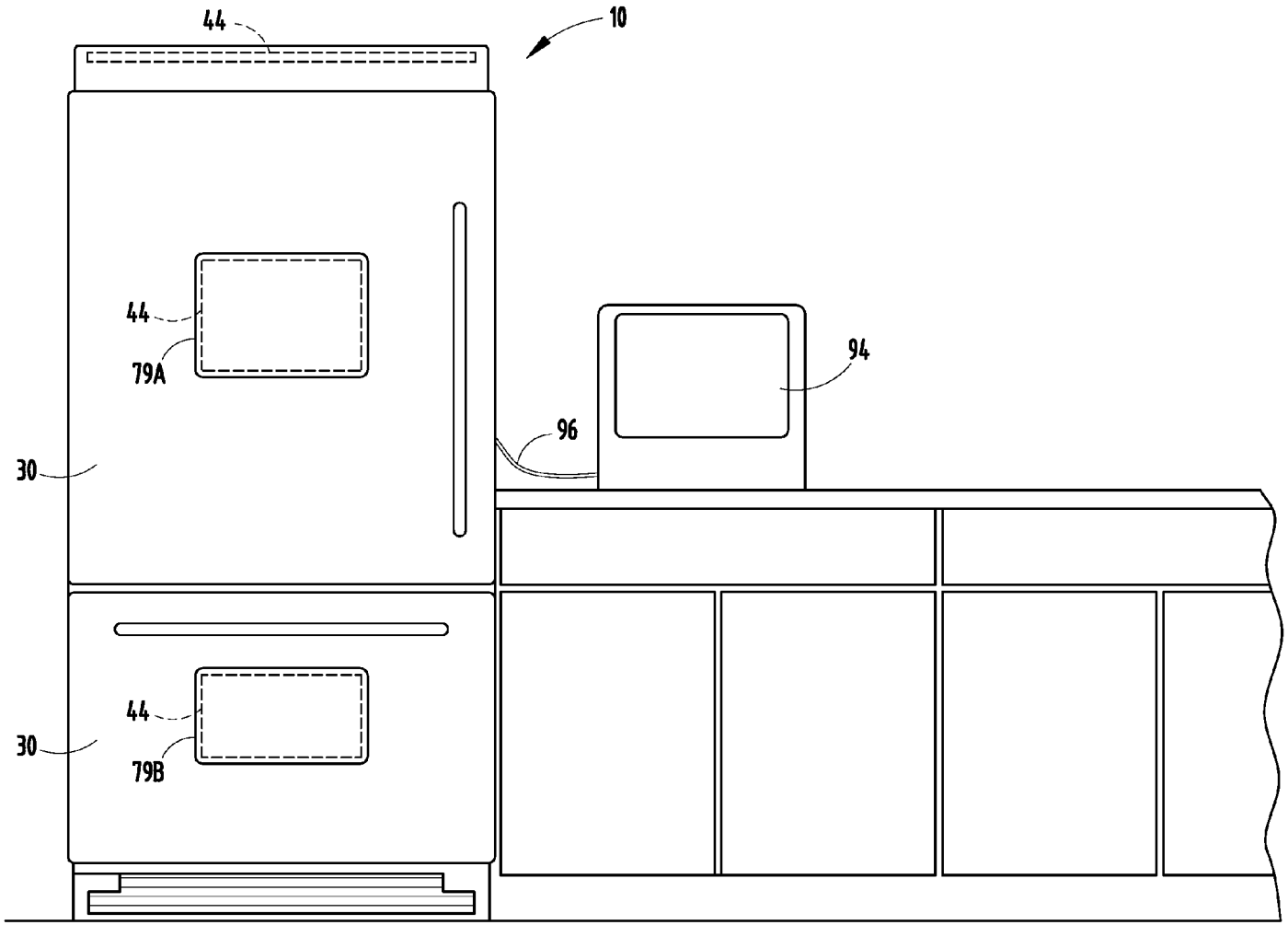
FIG. 16 is a front elevational view of a refrigerator having a plurality of insulation panels connected therewith to optimize thermal efficiency and an external parasitic modular component attached thereto.

Referring now to FIG. 16, in yet another embodiment of the present invention, insulation panels 44 are applied to the refrigerator 10 to increase efficiency of the refrigerator 10 due to the energy consumption and thermal loss associated with a parasitic exterior component 94. Specifically, the exterior parasitic component 94 is connected via a utility line 96 to the refrigerator 10 and may draw electricity, air, or water from the refrigerator 10. The parasitic external component 94 draws energy from the refrigerator 10, thereby decreasing the thermal efficiency of the refrigerator 10. Accordingly, to maximize efficiency in the refrigerator 10, insulation panels 44 are shown applied to the top wall 22 of the refrigerator 10 to reduce heat gain to the cooled interior space and thus offset the parasitic energy load developed by the parasitic external component 94. Similarly, with upper and lower removable modules 79A, 79B, the insulation panels 44 have been applied between the refrigerator door 30 and the upper removable module 79A, as well as between a freezer door and the lower removable module 79B.

In one embodiment, a method of using the refrigerator includes forming the cabinet 12 in the refrigerator 10 to define the open storage space 14 with the rear wall 16, first side wall 18, second side wall 20, top wall 22, and bottom wall 24, with each of the walls 16, 18, 20, 22, 24 including the interior liner 26 and the exterior wrapper 28. The door 30 is operatively connected to the cabinet 12. The door 30 also includes the interior liner 26 and the exterior wrapper 28. The utility line 85 is connected between the refrigerator 10 and the external modular component 79. The pocket 40 is formed in at least one of the rear wall 16, first side wall 18, second side wall 20, top wall 22, bottom wall 24, and door 30 adjacent the interior liner 26. The removable insulation panel 44 is inserted in the pocket 40 to improve energy efficiency of the refrigerator 10. The utility line 85, which may include a cold air line, refrigerant line, conditioned water line, electrical power line, electrical signal line, pneumatic line for power or signal communications, or any combination thereof, is connected between the refrigerator 10 and the external modular component 79. The pocket door 60 may be used to conceal the insulation panel 44 and is operable between an open position 32 and a closed position 34 on the refrigerator 10. The pocket door 60 fully covers the access opening 42 when in the closed position 34. The pocket door 60 may be hingedly attached to the refrigerator 10. The insulation panel 44 may be a vacuum insulation panel, or an expanded polystyrene panel, polyurethane panel, or an aerogel panel.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A refrigerator comprising: a rear wall, a first side wall, a second side wall, a top wall, and a bottom wall that are permanently attached to define a cabinet, the cabinet including an interior liner operably coupled with an exterior wrapper; a door pivotally connected with the cabinet and including an interior liner and an exterior wrapper; a pocket defined by an outer surface of at least one of the rear wall, first side wall, second side wall, top wall, bottom wall, and door, the pocket being free of communication with an interior volume between the interior liner and the exterior wrapper, the pocket including an access opening defined by an outer surface of one of the interior liner and the exterior wrapper; a removable insulation panel disposed in the pocket, wherein the removable insulation panel is removable from the pocket while the interior liner remains operably coupled with the exterior wrapper; and a pocket door configured to selectively cover at least a portion of the pocket, wherein the pocket door is operable between open and closed positions, the pocket door fully covering the access opening when the pocket door is in the closed position; and wherein the pocket door is hingedly attached to the refrigerator.

2. The refrigerator of claim 1, wherein a portion of the interior liner is permanently attached directly to a portion of the exterior wrapper.

3. The refrigerator of claim 1, wherein the pocket door is held in the closed position by one of a magnetic fastener, a chemical fastener, and a mechanical fastener.

4. The refrigerator of claim 1, wherein the removable insulation panel includes at least one tapered side edge.

5. A method of making a refrigerator, the method comprising: forming an exterior wrapper by permanently attaching a rear wall, a first side wall, a second side wall, a top wall, and a bottom wall together; integrally forming an interior liner for installation into the exterior wrapper; forming a pocket in one of the rear wall, first side wall, second side wall, top wall, and bottom wall; defining an interior volume between the interior liner and the exterior wrapper wherein the pocket is free of communication with the interior volume; forming an access opening to the pocket at one of the rear wall, first side wall, second side wall, top wall, and bottom wall; and inserting a removable insulation panel in the pocket, wherein the removable insulation panel can be removed from the pocket while the interior liner remains installed in the exterior wrapper; operatively connecting a pocket door operable between open and closed positions to the refrigerator, wherein the pocket door fully covers the access opening when in the closed position; and the pocket door is hingedly attached to the refrigerator.

6. The method of claim 5, further comprising:

permanently attaching the interior liner with the exterior wrapper.

7. The method of claim 5, further comprising: installing one of a magnetic fastener, a chemical fastener, and a mechanical fastener in the refrigerator that is adapted to releasably hold the pocket door in the closed position.

* * * * *